United States Patent [19]

Hoover et al.

[11] 3,980,181

[45] Sept. 14, 1976

[54] COLOR SORTING APPARATUS

[75] Inventors: Michael C. Hoover; Elias H. Codding, both of Houston, Tex.

[73] Assignee: Geosource Inc., Houston, Tex.

[22] Filed: June 19, 1975

[21] Appl. No.: 588,219

[52] U.S. Cl. ..... 209/111.6; 356/179

[51] Int. Cl.[2] ..... B07C 5/342

[58] Field of Search ..... 209/111.6, 74; 356/178, 356/179, 173

[56] References Cited

UNITED STATES PATENTS

| | | | |
|---|---|---|---|
| 3,137,392 | 6/1964 | Slight | 209/111.5 |
| 3,179,247 | 4/1965 | Hutter et al. | 209/74 |
| 3,209,910 | 10/1965 | Palmer et al. | 209/74 |
| 3,393,800 | 7/1968 | Durand, Jr. | 356/178 X |
| 3,750,883 | 8/1973 | Irving et al. | 209/111.6 |
| 3,762,546 | 10/1973 | Keitel et al. | 356/178 X |
| 3,781,554 | 12/1973 | Krivoshiev et al. | 209/111.6 X |
| 3,782,544 | 1/1974 | Perkins | 209/111.6 |
| 3,872,306 | 3/1975 | Palmer | 209/111.5 |

*Primary Examiner*—Allen N. Knowles

*Attorney, Agent, or Firm*—Arnold, White & Durkee

[57] ABSTRACT

Apparatus for sorting a random stream of articles moving along a wide path in a product flow according to their color. When an article having an unacceptable color is detected, a signal is generated to activate an ejector to remove the unacceptable article from the product flow. Apparatus according to the present invention is especially suitable for use in the field, in combination with harvesting apparatus, for sorting ripe produce such as tomatoes from unripe produce and other unwanted articles, all of which conveniently may be delivered to the apparatus randomly disposed on a conveyor belt. As the articles are discharged from the conveyor belt, they are viewed by a bichromatic color sensing system which generates one or more reject signals in response to each unacceptably colored article. The reject signals activate corresponding ejectors at the proper time to divert the unacceptable articles from the product flow.

11 Claims, 5 Drawing Figures

FIG. 1
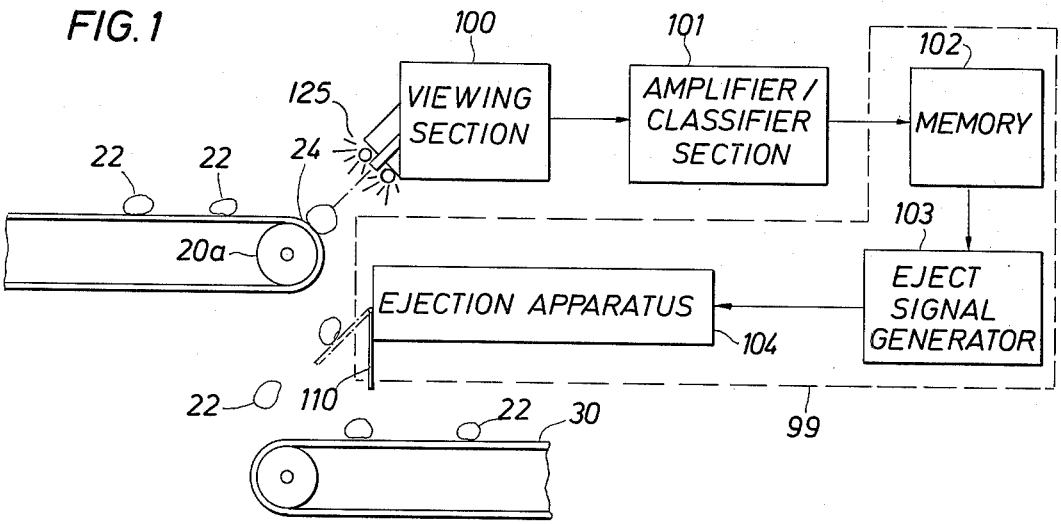
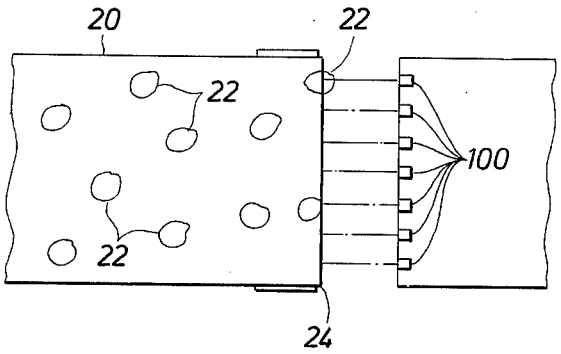
FIG. 2
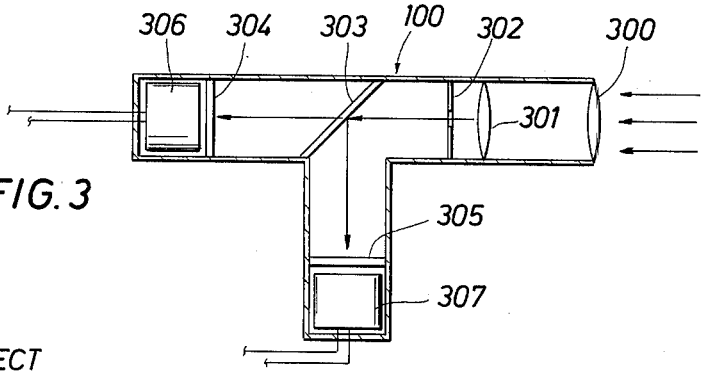
FIG. 3
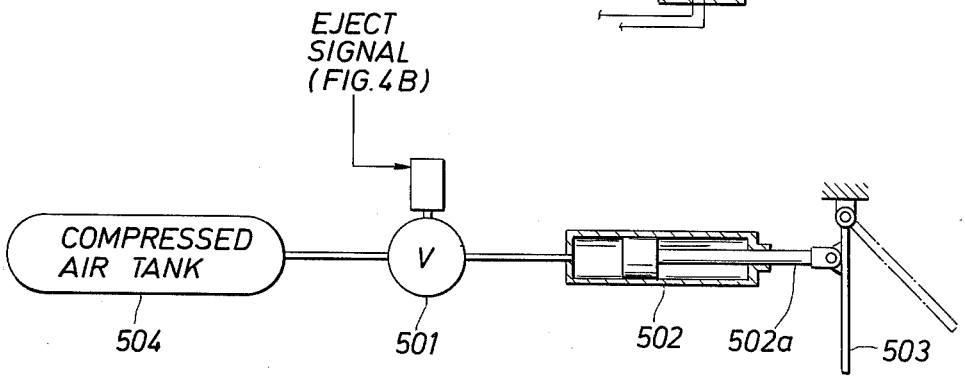
FIG. 5

COLOR SORTING APPARATUS

BACKGROUND OF THE INVENTION

1. Field of the Invention

The present invention relates to sorting machines, and, more particularly, to sorting machines for automatically sorting a random stream of articles or products moving along a wide path based upon their color content.

2. Description of the Prior Art

In recent years the cost of labor to manually extract unacceptable comestible products from acceptable products has drastically increased. This increase in the cost of labor has triggered a not insignificant amount of activity in the design and manufacture of sorting machines to accomplish the tasks previously accomplished by manual labor. These machines have made possible the rapid sorting of many comestible products in a number of applications.

The sorting of comestible products according to their degree of ripeness is generally done on the basis of color differences between the ripe and the "green" products. U.S. Pat. No. 3,206,022 refers to one such color sorting machine in which apples are inspected, or viewed, and sorted according to their color characteristics at two selected wavelengths. This and other such color sorters, however, require that the articles being sorted be presented one at a time to a viewing or inspection zone or chamber for the color determination. The capacity of such machines is limited by the need for singulation of the product. Although capacity can be increased by providing a number of such machines side-by-side for parallel operation, the cost is greatly increased. In addition, bichromatic color sorting machines heretofore have been especially sensitive devices not suited to use in rugged environments.

One device intended for sorting a flow of products randomly located across a wide path is described in U.S. Pat. No. 3,872,306, in which ionizing radiation is used to identify dirt clods and stones for separation from potatoes as the potatoes are harvested. Another device for sorting such a flow of products is described in U.S. Pat. No. 3,179,247, in which the separation of rock salt from other matter is accomplished on the basis of differences in translucency. Neither of these devices, however, includes the bichromatic color sorting apparatus required for sorting most comestible products according to degree of ripeness.

Various bichromatic optical devices have been developed for determining the color of articles passing through an inspection chamber or viewing zone. For example, U.S. Pat. No. 3,867,039 relates to an optical system for viewing a large area of a product stream and generating an electrical signal representative of the average color of the articles in the viewed area. This apparatus, however, is not a sorting machine and does not respond to remove unacceptably colored products from the product flow, nor does it individually identify or determine the color of any particular single product article flowing through its viewing area. This apparatus is intended for production process control applications, in which the average color of the product stream is used to control various process parameters.

SUMMARY OF THE INVENTION

The apparatus according to the present invention monitors the color of individual products in a wide flow path of randomly located products. Those products meeting acceptable color standards and those not meeting acceptable color standards are separated from one another.

In one embodiment of the present invention, a rugged sorting device having low power consumption is adapted to be connected near the discharge end of a conveyor belt on a harvesting machine to monitor the color of products as they reach the end of the belt. In this embodiment, the apparatus includes a plurality of side-by-side viewing channels, each having a viewing section to gather light reflected from the products leaving the end of the conveyor belt. Light-sensitive transducers generate corresponding electrical signals in response to the intensity of light of preselected colors reflected from side-by-side areas across the conveyor belt as the product flows through the viewing section. One light-sensitive transducer preferably generates an electrical signal in response to light having a color of an acceptable product, and the other light-sensitive transducer responds to light of a color of an unacceptable product.

Each viewing channel of the apparatus according to this illustrative embodiment of the present invention also includes an amplifier/classifier section. The outputs of the light-sensitive transducers of each viewing section are coupled, as inputs, to the respective amplifier/classifier section. The amplifier/classifier sections amplify the electrical signals produced at the outputs of the light-sensitive transducers, and generate corresponding signals functionally related to the ratio of the amplified electrical signals. In this way, the effect of changes in ambient light levels, such as might be due to dirt or dust build-up in the optical system of the device, is effectively eliminated.

In a preferred embodiment of the present invention, each amplifier/classifier section also compares the output of the light-sensitive transducer which responds to colors of acceptable products with a predetermined voltage level. If the color signal is not greater than this predetermined voltage, a second signal is generated by the amplifier/classifier section to indicate that fact and/or to activate the corresponding ejector.

Each channel of the present apparatus further includes an ejection system. These ejection systems are responsive to either of the two signals generated by the corresponding amplifier/classifier section. If either of these two signals reaches a predetermined level, the apparatus is activated to remove the unacceptable product from the product flow.

In a preferred embodiment, each of the ejection systems includes a memory, an ejection signal generator, and ejection apparatus. The memory is provided to store a signal indicative of the color acceptability of the product viewed by its corresponding viewing section. The input to this memory is responsive to the outputs of its corresponding amplifier/classifier section. The memory also may be utilized to delay activation of the ejection system whenever an unacceptable product is detected, giving the unacceptable product sufficient time to fall from the conveyor belt to the near proximity of the ejection apparatus.

An ejection signal generator is provided to generate a signal to energize the ejection apparatus, and it is responsive to the signal at the output of the memory. If an unacceptable product has been detected, then the ejection signal generator generates a signal of preselectable duration at its output.

Ejection apparatus according to the preferred embodiment of the present invention is responsive to the signals output from the corresponding ejection signal generators. The ejection apparatus is preferably comprised of an air valve solenoid, an air cylinder, and a metal paddle. The electrical signal emerging from the ejection signal generator activates the air valve solenoid, which in turn activates the air cylinder. The metal paddle, which is preferably attached to the piston of the air cylinder, is displaced from its relaxed state to divert unacceptable products from the product flow when the air cylinder is activated.

In another embodiment of the invention, each viewing section is adjusted to gather light from only a specified area of the conveyor belt. Each channel operates independently of the other channels to enhance the removal of unacceptable products which may be viewed by several channels.

BRIEF DESCRIPTION OF THE DRAWINGS

In the accompanying drawings:

FIG. 1 is a side view of a dual conveyor belt system and a block diagram of the apparatus of the present invention;

FIG. 2 is a top view of the dual conveyor belt system of FIG. 1 and apparatus of the present invention which illustrates the areas of the conveyor belt which are viewed by each channel of the apparatus of the present invention;

FIG. 3 is an optical schematic diagram which illustrates the preferred embodiment of the viewing section used in each channel of the apparatus of the present invention;

FIG. 5 is a block diagram which illustrates another portion of the ejection system which is utilized in each channel of a preferred embodiment of the apparatus of the present invention.

DESCRIPTION OF THE PREFERRED EMBODIMENT

Figure 4A:
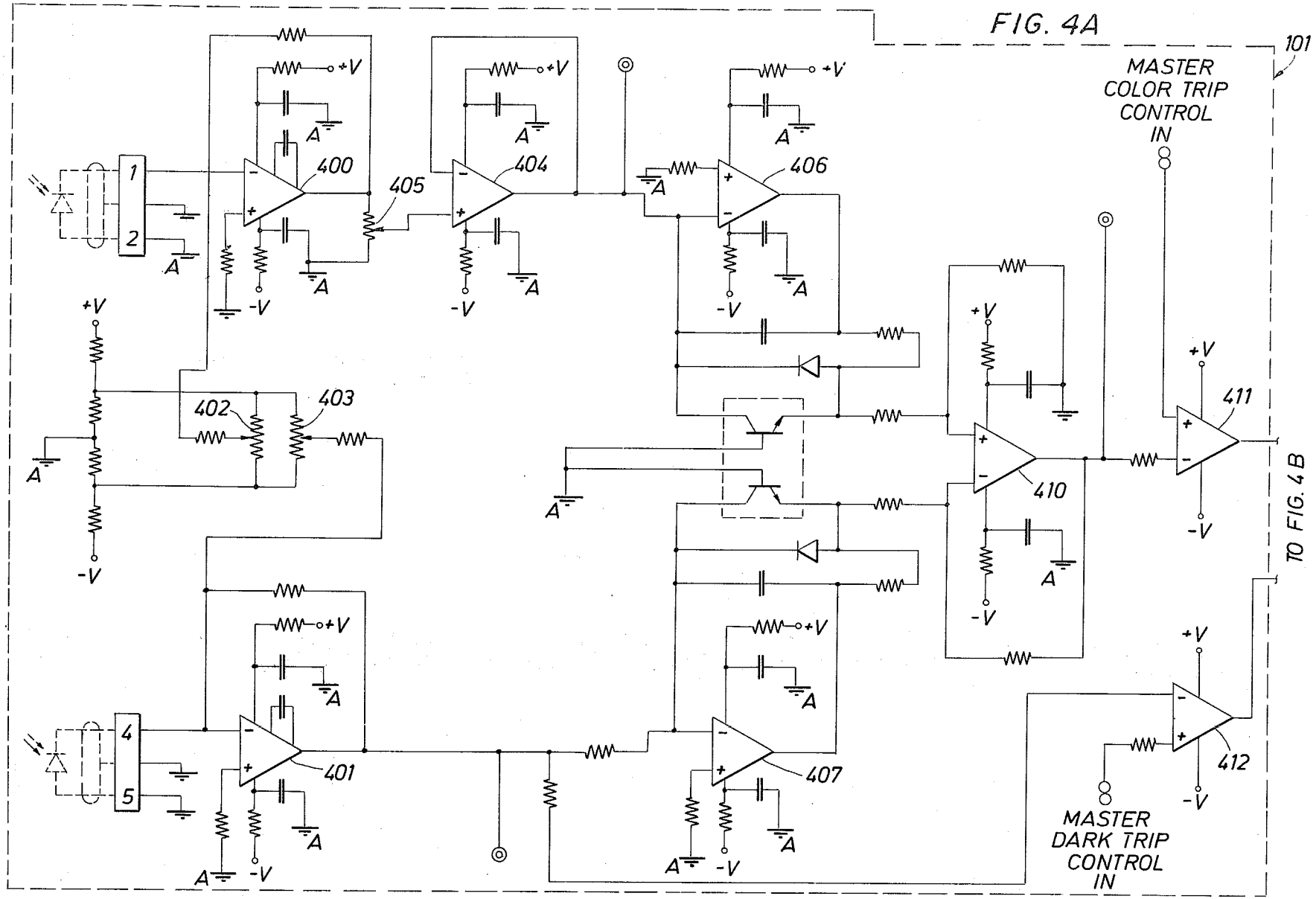
FIG. 4 is a detailed schematic diagram of the amplifier/classifier section and a portion of the ejection system which is utilized in each channel of a preferred embodiment of the apparatus of the present invention.

It will be appreciated that the present invention can take many forms and embodiments. One embodiment of the present invention will be described so as to give an understanding of the invention. The functioning of the apparatus of the present invention will be described primarily with respect to its utilization as a tomato sorter, but it is not intended that this description in any way limit the true scope and spirit of the invention.

Referring now to FIG. 1, there is shown a first, or product feed, conveyor belt 20 onto which articles 22 are randomly disposed for sorting. As the products 22 reach the discharge end 24 of the first conveyor belt 20, they fall to a second, lower, conveyor belt 30 with the general trajectory shown in FIG. 1. The apparatus of the present invention is highly effective in preventing those products not meeting acceptable color criteria from reaching the second conveyor belt 30. For example, when the articles 22 to be sorted are tomatoes, apparatus according to the present invention allows the red tomatoes traveling on the first conveyor belt 20 to fall onto the second conveyor belt 30 for further processing, but prevents substantially all of the green tomatoes from reaching the second conveyor belt 30.

Still referring to FIG. 1, an embodiment of the present invention is especially adapted for connection in near proximity to the discharge end of the first conveyor belt 20. This embodiment comprises a plurality of channels, wherein each channel includes a viewing section 100 which gathers light from a predetermined portion of the width of conveyor belt 20 and which generates electrical signals whose amplitudes are proportional to the magnitude of specified colors which are viewed. Each channel further includes an amplifier/classifier 101 which amplifies the electrical signals received from the viewing section 100 and generates an electrical signal which classifies the products viewed by the viewing section 100 as acceptable or unacceptable. Each channel further includes an ejection system 99, and the signal indicative of the acceptability or unacceptability of the viewed product is presented to the input of the ejection system 99. If a product viewed in one or more channels is unacceptable, then the corresponding ejection systems 99 are activated to divert the unacceptable product from the product stream.

Referring now to FIG. 2, a sufficient number of side-by-side sorting channels are provided so that light may be gathered from products disposed at any location across the width of the first conveyor belt 20. Each viewing section 100 is preferably oriented and adjusted to view only a small portion of the width of the discharge end 24 of the conveyor belt 20, a preferred embodiment including means for viewing a one-inch wide section of the belt. Twenty-two viewing sections 100 may be utilized, for example, when the width of the belt is 22 inches. The viewing section 100 are installed in side-by-side spaced relationship to one another, uniformly spaced from the discharge end of the conveyor belt 20. Each viewing section 100 is adjusted to gather light from a viewed area of the conveyor belt 20 one inch wide and one-half inch long (along the path of the belt). The light gathered from this viewed area by each viewing section 100 will, for convenience of reference, sometimes herein be called the "viewing beam."

With reference again to FIG. 1, one embodiment of the apparatus of the present invention includes a source of illumination 125 mounted in near proximity to the viewing sections. This source of illumination directs light uniformly across the width of the conveyor belt 20 to illuminate the products 22 as they pass through the viewed area. In one embodiment of the present invention, the source of illumination 125 includes a plurality of fluorescent lights, one-half of the lights radiating light of the color of acceptable products and the other half radiating light of the color of unacceptable products. It will be understood, of course, that numerous other sources of illumination as known in the art may be used, including incandescent lamps and other types of fluorescent tubes.

Referring now to FIG. 3, each viewing section 100 (FIG. 1) includes an object lens 300, a defocusing lens 301, an optical frame 302, a beam splitter 303, first and second filters 304 and 305 located in the respective portions of the split beam, and first and second solar cells 306 and 307 for receiving the respective filtered light. In the illustrated embodiment of the present invention, the viewing sections 100 are positioned on a line making approximately a 30° angle with a horizontal line drawn through the center of pulley 20*a*, as shown in FIG. 1.

With reference now to both FIGS. 1 and 3, as articles 22 (FIG. 1) reach the discharge end 24 of the upper conveyor belt 20, each of the articles 22 passes through one or more viewed areas. The light reflected from each of the viewed areas travels through a corresponding object lens 300, defocusing lens 301, and frame member 302. Each frame member 302 is adjustable to allow the corresponding viewing section 100 to gather light from a defined viewed area. The light passing through the frame member 302 is then directed toward the beam splitter 303. Beam splitter 303 passes a portion of the light through the first filter 304 and reflects the remaining portion of the light through the second filter 305.

The characteristics, e.g., color wavelengths, of the filters 304 and 305 are selected according to the color of the products 22 to be sorted. For example, when the apparatus of the present invention is utilized to sort tomatoes, the colors of filters 304 and 305 are selected to pass light of red and green wavelengths, respectively. The light passing through each filter impinges upon the corresponding solar cell 306 and 307. The filter light received by each of the solar cells is completely diffused, having no image characteristics of the product 22 from which the light was gathered, but rather representing the instantaneous average color of the light reflected from the corresponding viewed area of the belt carrying the randomly located products 22.

Each of the solar cells 306 and 307 generates an electrical signal representative of the intensity of the filtered light impinged upon it. When apparatus according to the present invention is utilized to sort green tomatoes from red tomatoes, then the magnitudes of the electrical signals present at the output of solar cells 306 and 307 are indicative of the amounts of red and green color of the articles as they pass through the viewing beam of the viewing section 100.

Figure 4B:
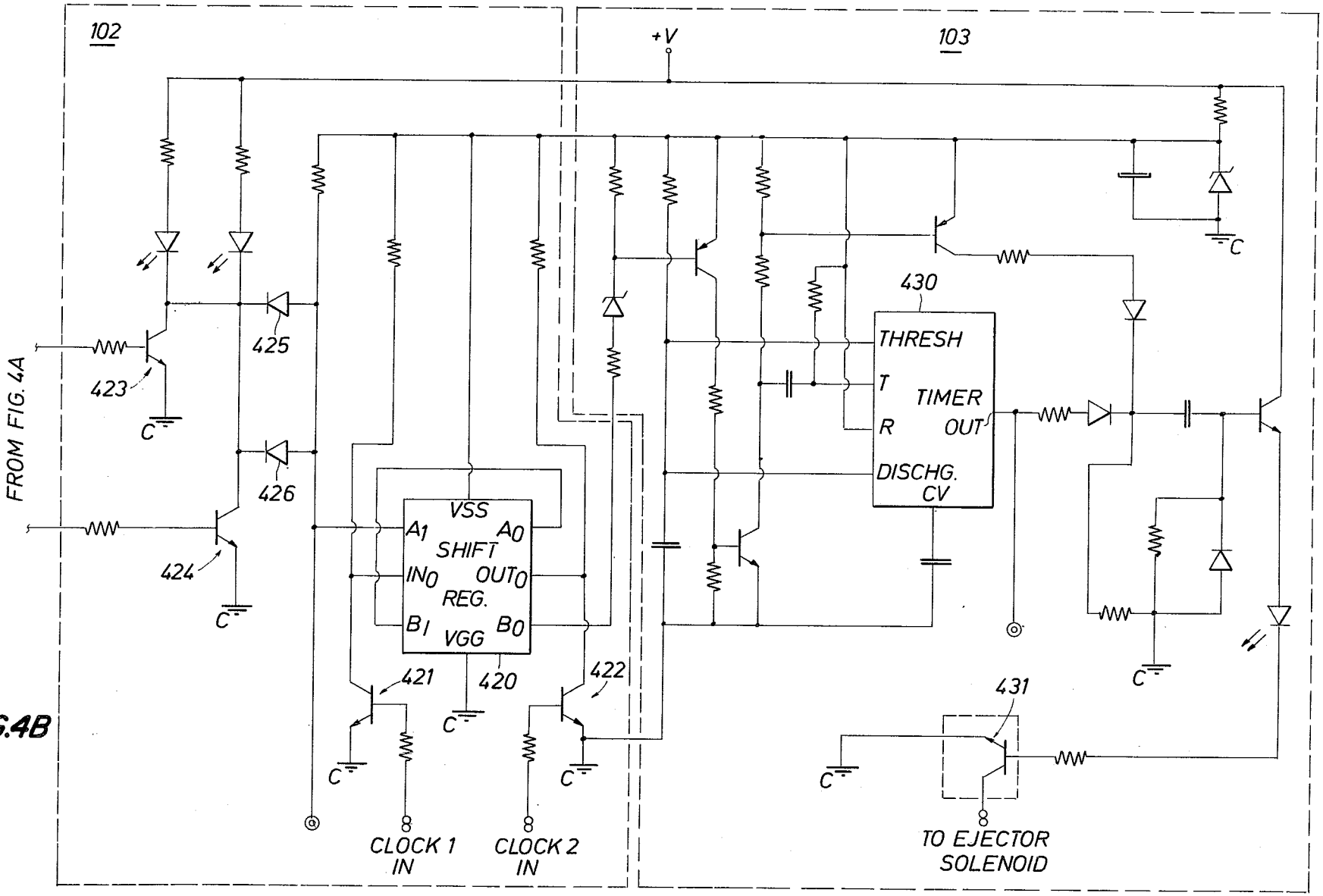

Referring now to FIG. 4, there is shown a detailed schematic diagram of one embodiment of the amplifier/classifier section 101 utilized in each channel of the apparatus of the present invention. As shown, the inputs to the amplifier/classifier are coupled to the outputs of its corresponding viewing section 100.

The electrical signals generated by solar cells 306 and 307 are coupled to the inverting inputs of operational amplifiers 400 and 401, respectively. As previously mentioned, the signal emerging from one of the solar cells 306 or 307 is preferably a signal representative of an unacceptable color in the product which has been viewed. When the sorting apparatus of the present invention is utilized to sort green tomatoes from red tomatoes, the signal emerging from the solar cell which was sensitized by green light is preferably coupled to the inverting input of operational amplifier 400, and the signal emerging from the solor cell which was sensitized by red light (acceptable product) is preferably coupled to the inverting input of operational amplifier 401.

Operational amplifiers 400 and 401 are connected in the familiar inverting configurations, and each of these configurations provides a gain to the signal presented to its input. The input color signals generated by the sensors 306 and 307 are supplied to amplifiers 400 and 401 in the form of negative voltages, and the corresponding outputs are therefore positive voltages. Null adjustments are provided for operational amplifiers 400 and 401 by potentiometers 402 and 403, respectively. The outputs of operational amplifiers 400 and 401 may be set to approximately zero volts by adjustment of potentiometers 402 and 403, respectively, in the absence of input signals to compensate for offset voltages inherent in the amplifiers.

The output of operational amplifier 400 is coupled to a gain adjust potentiometer 405, whose function will be described below. The output of the gain adjust potentiometer is coupled to the non-inverting input of operational amplifier 404, and operational amplifier 404 is connected in the familiar non-inverting configuration.

The outputs of operational amplifiers 404 and 401 are coupled to the inverting inputs of operational amplifiers 406 and 406, respectively. Operational amplifiers 406 and 407, with their associated circuitry, are each connected as logarithmic amplifiers. In other words, the outputs of amplifiers 406 and 407 are the natural logarithms of the signals presented as inputs to them, in the form of negative voltages. The outputs of operational amplifiers 406 and 407 are coupled to the non-inverting and the inverting inputs, respectively, of operational amplifier 410.

Operational amplifier 410 is connected in the familiar differential mode, so that its output represents the difference between the signals presented to the non-inverting input and the inverting input. Since the inputs to operational amplifiers 410 are negative voltages representative of the logarithms of the signals presented to amplifiers 406 and 407, the output of amplifier 410 is functionally related to the ratio of the red to the green color signals output from amplifiers 404 and 401, respectively.

In the illustrated embodiment of the present invention, the output of operational amplifier 410 is coupled to the inverting input of operational amplifier 411. The non-inverting input of operational amplifier 411 is coupled to a signal labeled MASTER COLOR TRIP CONTROL, which supplies a controllable reference voltage to the non-inverting input. The output of operational amplifier 411 shownin the illustrated embodiment will assume one of two voltage levels depending upon the voltages at its inputs. When the voltage at its non-inverting input exceeds the voltage at its inverting input, the voltage at its output will be approximately +12 volts. When, however, the voltage at its inverting input exceeds the voltage at its non-inverting input, the voltage at the output will be approximately −12 volts.

The voltage level at the inverting input is determined by the ratio of the red to green signal strengths which are received. Gain adjust potentiometer 405 is provided, therefore, to set the output of amplifier 410 to an appropriate level before the sorting process begins. In the illustrated embodiment of the invention, this level is slightly greater than the MASTER COLOR TRIP CONTROL voltage when no product is on conveyor belt 20. In other words, the output of amplifier 410 is set with gain adjust potentiometer 405 without any products 22 on the conveyor belt 20, so that only the belt is being viewed.

When a ripe, red tomato is viewed by one of the viewing sections of the present apparatus, the ratio of the red color signal to the green color signal is such that the output of operational amplifier 410 will be more positive than the value to which it was initially set by gain adjust potentiometer 405. Since the output of operational amplifier 410 is coupled to the inverting input of operational amplifier 411, the voltage level of the output of operational amplifier 411 will remain at −12 volts and transistor 423 will remain non-conducting.

When, however, a green tomato is viewed, the ratio of the red signal to the green signal is low and the signal on the inverting input of operational amplifier 411 is less than the value to which it was initially set by gain adjust potentiometer 405. The voltage present on the non-inverting input from the signal MASTER COLOR TRIP CONTROL then exceeds the signal at the non-inverting input, and the output of operational amplifier 411 is switched to +12 volts and transistor 423 is rendered conductive.

From the foregoing it should be apparent that changes in ambient light intensity should not adversely affect the sorting performance of apparatus according to the present invention, because changes in ambient lighting will affect the intensity of the green and the red input signals to about the same degree. For the same reasons, any dust which collects on the exterior of object lens 300 (FIG. 3) of viewing section 100 (FIG. 1) will not significantly affect the sorting performance of the apparatus. This insensitivity to changes in ambient lighting levels and dust accumulation is achieved because the output of amplifier 410 is functionally related to the ratio of the red to the green color signals rather than the difference between them.

Referring still to FIG. 4, operational amplifier 412 is provided in the illustrated embodiment of the present invention to generate a reject command in response to the presence of dirt clods or articles covered with mud which may be present in the product flow on conveyor belt 20 (FIG. 1). The noninverting input of amplifier 412 is coupled to the signal indicated as MASTER DARK TRIP CONTROL, and the inverting input is coupled to the output of operational amplifier 401. Remembering that operational amplifier 401 is preferably utilized to amplify the signal of an acceptable product, the output of operational amplifier 412 will normally be negative because the voltage at the inverting input exceeds the voltage at the non-inverting input from MASTER DARK TRIP CONTROL. When, however, a dirt clod is encountered in the product flow, the output of operational amplifier 401 will drop to a level far below the MASTER DARK TRIP CONTROL voltage at the non-inverting input of amplifier 412. In this situation, the output of amplifier 412 will switch to +12 volts and transistor 424, connected to the output of amplifier 412, will be rendered conductive.

With reference again to FIG. 1, ejection system 99 includes a memory 102, an ejection signal generator 103, and an ejection apparatus 104. Memory 102 is provided to store a signal generated by its corresponding amplifier/classifier section 101 which is indicative of the color acceptability of the product viewed by its corresponding viewing section 100. The input to memory 102 is responsive to the outputs of its corresponding amplifier/classifier section 100, and memory 102 is utilized to delay the activation of ejection system 99 until the products leaving conveyor belt 20 have had sufficient time to fall into sufficiently near proximity to ejection apparatus 104 for ejection thereby. The voltage level of the signal emerging at the output of memory 102 is indicative of the color acceptability of the products to be sorted.

Ejection signal generator 103 has inputs which are responsive to the voltage level of the output of memory 102, and is provided to generate a signal to energize ejection apparatus 104 when an unacceptable product has been detected in the product flow. The duration of the signal thus generated will be determined as discussed below.

Ejection apparatus 104 is responsive to the signal generated at the output of its corresponding ejection signal generator 103. When the ejection apparatus is energized, the product or article causing its energization will be removed from the product flow.

Still referring to FIG. 4, there is illustrated one embodiment of memory 102 of FIG. 1. It is comprised of a shift register 420, transistors 421–424, and diodes 425 and 426.

The input to shift register 420 is the signal present at the junction between the anodes of diodes 425 and 426. This signal will be a logical 1 (approximately +12 volts) if the amplifier/classifier section 101 has classified the product as acceptable. If, however, the amplifier/classifier section 101 has classified the product as unacceptable, as discussed above, the voltage level output from either operational amplifier 411 or 412 will forward bias transistor 423 or transistor 424, respectively. In either case, a logical 0 will be loaded in the input of shift register 420.

In the illustrated embodiment of the present invention, shift register 420 is an MM5006AH, such as are manufactured by National Semiconductor Corporation. This device is a dual 100 bit shift register, and the device is connected as shown in FIG. 4 to form a single 200 bit shift register. External clock signals, designated in FIG. 4 as Clock 1 and Clock 2, are provided to the bases of transistors 421 and 422, respectively. When either of these clock signals is a logical 1, the corresponding base-emitter junction transistor, 421 or 422, is forward-biased, thereby providing shift pulses to shift register 420.

Referring still to FIG. 4, there is shown one embodiment of an ejection signal generator 103 (FIG. 1) according to the present invention. It comprises a timer 430 which, when activated, generates a reject pulse of specific duration at its output. The duration of this pulse may be varied by variation of the timing capacitors and resistors associated therewith. In the illustrated embodiment of the invention, the reject pulse width is 50 milliseconds. Any low value (logical 0) which is shifted out of the shift register 420 activates timer 430. The output of timer 430, when activated, forward-biases the base-emitter junction of transistor 431, thereby causing current to flow to the ejector solenoid (not shown) for actuation of the ejector paddle. Timer 430 is preferably an NE555, such as are manufactured by Signetics Corp.

With reference now to FIG. 5, one embodiment of ejection apparatus 104 (FIG. 1) according to the present invention is illustrated. It comprises an air valve solenoid 501, an air cylinder 502, and a metal paddle 503. When current flows in the collector of transistor 431 (FIG. 4), the air valve solenoid 501 is activated and compressed air is allowed to flow from air tank 504 into air cylinder 502. The piston 502*a* of air cylinder 502 is connected to metal paddle 503 by suitable means, e.g., a pin. When air flows into air cylinder 502, the piston 502*a* is extended to displace metal paddle 503 from its relaxed state.

Referring now to FIG. 1, when metal paddle 503 is displaced from its relaxed state, it assumes the position shown by dotted line 110. This displacement of paddle 503 occurs in response to detection of an unacceptable item 22 in the corresponding sorting channel or area of the conveyor belt 20 viewed by the sorting apparatus. The normal trajectory of the product 22 from the upper belt 20 to the lower belt 30 is then diverted by paddle 503, thereby removing the unacceptable item 22 from the product flow.

As aforesaid, each of the elements shown in FIG. 1 are present in each channel of the sorting apparatus of the present invention. This being the case, there are a plurality of metal paddles extending across an area equal to the width of conveyor belt 20. Since the side-by-side arrangement of the viewing apparatus 100 provides substantially continuous viewing across the entire width of conveyor belt 20, it is possible that more than one metal paddle may be activated to prevent any given product from reaching conveyor belt 30, depending upon the size of the product and its lateral location on the belt.

It will be apparent from the foregoing discussion that numerous modifications may be made to the apparatus described herein without departing from the spirit and scope of the present invention. Accordingly, any such modifications which permit the apparatus to accomplish substantially the same objectives in substantially the same way are intended to be encompassed hereby.

What is claimed is:

1. Apparatus for sorting articles randomly disposed across a wide path in a product stream according to color, comprising:

means for viewing a selected illuminated area through which the product stream is passed, said viewing means including a plurality of viewing sections disposed in side-by-side spaced relationship to one another to view a corresponding plurality of viewed areas within the selected illuminated area, each of said viewing sections including means for generating first and second continuous electrical color signals representative of the instantaneous average value of the light energy reflected from the corresponding viewed area at respective first and second wavelengths selected from the optical frequency spectrum, classifier means operatively coupled to each of said viewing sections for generating a third continuous electrical color signal functionally related to the ratio of the first electrical color signal to the second electrical color signal, for comparing said third electrical color signal with a selected reference, and for generating a reject command in response to a change in said third electrical color signal representative of the presence of an unacceptably colored article in the corresponding viewed area, and, ejector means operatively coupled to each of said classifier means for receiving said reject command and separating the unacceptably colored article from the product stream in response to said reject command.

2. Apparatus for sorting articles randomly disposed across a wide path in a product stream according to color as recited in claim 1 including illumination means for lighting the selected illuminated area at the first and second wavelengths selected from the optical frequency spectrum.

3. Apparatus for sorting articles randomly disposed across a wide path in a product stream according to color as recited in claim 1 wherein each of said viewing sections includes an optical frame member disposed to define the corresponding viewed area, lens means defining a light beam representative of the light energy reflected from the viewed area, a beam splitter disposed in the light beam to form first and second light beams, first and second optical color filters disposed in the respective first and second light beams, and first and second light sensitive elements disposed in the respective filtered light beams to generate the corresponding electrical color signals.

4. Apparatus for sorting articles randomly disposed across a wide path in a prouct stream according to color as recited in claim 3 wherein said lens means includes a first lens having an object plane in the viewed area and an image plane at the optical frame member, and a second lens having an object plane at the first lens and an image plane at the respective light sensitive elements to project a wholly diffuse beam of light energy on each of said light sensitive elements.

5. Apparatus for sorting articles randomly disposed across a wide path in a product stream according to color as recited in claim 4 wherein said light sensitive elements comprise solar cells.

6. Apparatus for sorting articles randomly disposed across a wide path in a product stream according to color as recited in claim 1 wherein each of said classifier means includes:

first-stage amplifier means operatively coupled to the respective first and second electrical color signals to increase the intensity of said signals, logarithmic amplifier means operatively coupled to the output of said first-stage amplifier means to generate first and second electrical signals proportional to the natural logarithms of said amplified first and second electrical color signals, differential amplifier means operatively coupled to said logarithmic amplifier means for generating a continuous electrical color ratio signal functionally related to the ratio of said first electrical color signal to said second electrical color signal, reference signal means for providing a selectable electrical reference signal, and classifier means operatively coupled to receive said reference signal and said color ratio signal for generating a reject command whenever the reference signal exceeds the color ratio signal.

7. Apparatus for sorting articles randomly disposed across a wide path in a product stream according to color as recited in claim 6 including means to adjust the gain of at least one amplifier of said first-stage amplifier means.

8. Apparatus for sorting articles randomly disposed across a wide path in a product stream according to color as recited in claim 1 wherein each said ejector means includes:

memory means operatively coupled to said corresponding classifier means for receiving said reject commands and outputting corresponding reject electrical signals after a preselected time interval, reject signal generator means operatively coupled to said memory means for generating an output electrical signal having a selected minimum duration in response to each of the reject electrical signals received from said memory means, and means operatively coupled to said signal generator means for diverting articles from the product flow responsive to the output of an electrical signal from said reject signal generator means.

9. Apparatus for sorting articles randomly disposed across a wide path in a product stream according to color as recited in claim 8 wherein said memory means comprises a shift register having an output to which an input is shifted after a predetermined time interval.

10. Apparatus for sorting articles randomly disposed in across a wide path in a product stream according to color as recited in claim 8 wherein said diverting means comprises a paddle adapted to be moved into the path of the product flow responsive to the output of an electrical signal from said reject signal generator means.

11. Apparatus for in-field sorting articles randomly disposed across a wide path in a moving product stream according to color and dissimilarity to foreign objects, comprising:

means for illuminating a selected area through which the moving product stream is passed, viewing means for sensing the light energy reflected from the illuminated area and generating a plurality of first and second electrical color signals representative of the instantaneous average value of the light energy reflected from each of a corresponding plurality of viewed areas at respective first and second wavelengths selected from the optical frequency spectrum, said viewed areas being disposed laterally across the product stream within the illuminated area, amplifier means operatively coupled to said viewing means for receiving said plurality of first and second electrical color signals and generating a color ratio signal functionally related to the ratio of each first electrical color signal to the corresponding second electrical color signal, classifier means for receiving each of the color ratio signals and comparing said color ratio signals to a reference signal selected to define a minimum color ratio signal level indicative of acceptably colored articles in the product stream, said classifier means including means for outputting a reject command whenever the color ratio signal is less than the reference signal, comparator means coupled to each of said viewing sections for comparing each of said first electrical signals with a second selected reference functionally related to the energy reflected from a foreign object, and for generating a reject command responsive to the presence of a foreign object in the corresponding viewed area, and a plurality of ejectors disposed laterally across the product stream at locations corresponding to the viewed areas, each of said ejectors being operative in response to a reject command from the classifier means and said comparator means for the respective viewed area to remove unacceptably colored articles and foreign objects from the corresponding portion of the product stream.

* * * * *